US006461478B1

(12) United States Patent
Meschenmoser

(10) Patent No.: US 6,461,478 B1
(45) Date of Patent: Oct. 8, 2002

(54) METHOD AND DEVICE FOR TREATING A FIBROUS MATERIAL WEB

(75) Inventor: Andreas Meschenmoser, Horgenzell (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/341,688

(22) PCT Filed: Jan. 23, 1998

(86) PCT No.: PCT/EP98/00371

§ 371 (c)(1),
(2), (4) Date: Sep. 3, 1999

(87) PCT Pub. No.: WO98/32917

PCT Pub. Date: Jul. 30, 1998

(30) Foreign Application Priority Data

Jan. 24, 1997 (DE) ..... 197 02 574

(51) Int. Cl.[7] ..... D21F 3/04

(52) U.S. Cl. ..... 162/205; 162/358.3; 162/360.2; 162/210

(58) Field of Search ..... 162/205, 210, 162/358.3, 360.2, 360.3

(56) References Cited

U.S. PATENT DOCUMENTS 2,869,737 A * 1/1959 Hornbostel et al. .... 162/DIG. 7
4,172,759 A * 10/1979 Kankaanpaa ..... 162/205
5,389,205 A 2/1995 Pajula et al. ..... 162/205
5,393,384 A * 2/1995 Steiner et al. ..... 162/360.3
5,468,349 A * 11/1995 Schiel ..... 162/360.2
5,520,782 A * 5/1996 Schiel ..... 162/360.3
5,522,959 A 6/1996 Iimarinen ..... 162/205
5,611,893 A 3/1997 Pajula et al. ..... 162/205
5,639,351 A 6/1997 Iimarinen ..... 162/205
5,820,731 A * 10/1998 Soderholm ..... 162/205
5,833,810 A * 11/1998 Laapotti ..... 162/360.3

FOREIGN PATENT DOCUMENTS

| | | | |
|---|---|---|---|
| DE | 4301750 | 7/1994 | |
| DE | 4301751 | 7/1994 | |
| DE | 19705030 | * 6/1998 | ..... 162/210 |
| EP | 0487483 | 5/1992 | |
| EP | 0549553 | 6/1993 | |
| WO | 95/33885 | 12/1995 | |

* cited by examiner

*Primary Examiner*—Karen M. Hastings
(74) *Attorney, Agent, or Firm*—Greenblum & Bernstein, P.L.C.

(57) ABSTRACT

Disclosed is method and a pressing device (10) of a paper and/or paperboard machine intended for the treatment of a fibrous web (12) which is formed on a band screen and passes around an appropriate open roller (16) having recessed intended to receive the water squeezed out the fibrous web. The open roller forms with a counterface a first nip (18) which is extended, in the direction of movement of the L band, by a pressing shoe unit (20). A papermaker's felt (22, 24) passes both on the open roller (16) and said pressing shoe unit (20).

75 Claims, 4 Drawing Sheets

METHOD AND DEVICE FOR TREATING A FIBROUS MATERIAL WEB

BACKGROUND OF THE INVENTION

1. Field of the Invention

The invention relates to a pressing device of a paper and/or paperboard machine for the treatment of a fibrous material web which is formed on a band screen and passes together with the band screen around a suitable open roll provided with recesses for receiving water pressed out of the fibrous web and forming a first nip with a counter-surface.

2. Description of Background and Relevant Information

A pressing arrangement of this kind is known from DE 43 01 751, the counter-surface associated with the open roll is formed by a cylindrical press roll with a rigid roll jacket and a smooth surface. The fibrous material web once separated from the band screen is transferred to the smooth surface of the press roll and is guided through a nip which is formed between this press roll and a pressing shoe roll associated with it. A notable dewatering thus arises in the nip formed between the press roll and the pressing shoe roll.

SUMMARY OF THE INVENTION

The invention provides a pressing device of the initially named kind which is of simple layout and kept compact, which a high dry content is obtained with the dewatering of the fibrous material web.

The invention provides for a pressing device for treating a fibrous material web including a band screen for carrying the material web which is formed upon it, an open roll comprising recesses for receiving water pressed out of the material web, a first nip extended in a web running direction being formed between the open roll and a counter-surface comprising a pressing shoe unit, at least one of the open roll and a suction device being provided to suction the material web on the band screen, an open roll felt belt being guided over the open roll and a pressing shoe felt belt being guided over the pressing shoe unit, a second nip arranged downstream the first nip, and another felt belt arranged to travel through the second nip with the material web, wherein the pressing shoe felt belt is separated from the material web while the material web and the band screen is suctioned, and wherein the material web is removed from the band screen between the first and second nips by one of a smooth belt and a smooth roll.

The pressing shoe unit associated with the open roll may be a shoe pressing roll. The open roll may comprise a surface having at least one of grooves and blind bores, said open roll further comprising a non-permeable press roll jacket lying beneath the surface. The open roll may be a suction roll and may include a roll jacket provided with a plurality of radial bores which are not through-bores, wherein the open roll is internally suctioned. The device may further comprise a gutter adapted to capture led-away spun-off water, wherein the open roll is at least partly surrounded by the gutter. The open roll may be a roll tube having a plurality of radial bores which are not through-bores, and wherein the open roll is externally suctioned. The device may further comprise an outer suction box which surrounds a portion of the open roll but which is not in contact with the open roll felt belt that is guided over the open roll. The suction box may comprise an end section having a suction opening adjacent the open roll, and wherein the end section is arranged to be substantially parallel to a pressing plane, wherein the open roll projects at least partly through the suction opening into the end section, wherein at least substantially an entire part of the open roll located outside of the suction box is surrounded by the open roll felt belt, and wherein the open roll felt belt is supported by an outer surface of the end section which is located adjacent to but not in contact with the open roll. The open roll felt belt may be guided symmetrically to a pressing plane of the first nip about the open roll and about the end section of the suction box. The band screen and the fibrous web may be guided away from the open roll at an angle of at least 2° relative to the open roll felt belt.

The invention also provides for a pressing device for treating a fibrous material web comprising a band screen for carrying the material web which is formed upon it, an open roll comprising recesses for receiving water pressed out of the material web, a first nip extended in a web running direction being formed between the open roll and a counter-surface comprising a pressing shoe unit, at least one of the open roll and a suction device being provided to suction the material web on the band screen, an open roll felt belt being guided over the open roll and a pressing shoe felt belt being guided over the pressing shoe unit, the pressing shoe felt belt and the material web being separated from each other after the material web is suctioned, the band screen and the fibrous web being guided away from the open roll at an angle of at least 2° relative to the open roll felt belt, and a separating suction device provided adjacent the band screen and positioned on the side of the open roll where the open roll felt belt separates from the band screen, wherein the separating suction device applies a vacuum suction to the fibrous web in order to dewater the fibrous web together with the band screen, and wherein the separating suction device leads away spun-off water originating from a wedge space defined by the position where the open roll felt belt and band screen separate, such that the separating suction device utilizes a front edge which acts as a deflector strip and extends into the wedge space between the band screen and the open roll felt belt.

The separating suction device may further comprise a gutter located transversely to the web running direction for receiving and leading away the spun-off water which is picked up ahead of the deflector strip of the suction separating device. The shoe pressing roll may comprise a flexible pressing jacket having an outer surface having recesses for receiving pressed-out water from the fibrous web, thereby facilitating even dewatering of the fibrous material web at the first nip, wherein even dewatering results on both sides of the fibrous web when the first nip comprises: the jacket surface; a water permeable felt belt; a water permeable band screen; a water permeable open roll felt belt; and the roll surface. The shoe pressing roll may be at least partly surrounded by a gutter for capturing and leading away the spun-off water from the recesses of the flexible pressing jacket. The second nip may be formed by a press roll and a counter-surface. The material web may be guided, after leaving the second nip, on the smooth belt to a further process section which is directly without an open web run, wherein the further process section includes a drying cylinder. The second nip may be formed by a pressing shoe arrangement which is extended in the web running direction. The pressing shoe arrangement may comprise a shoe press roll and a counter-surface. At least one of the press roll and the counter-surface may comprise a roll jacket which is supported by at least one support element against the other of the at least one of the press roll and the counter-surface. The press roll and the counter-surface may both comprise pressing shoe rolls with flexible pressing jackets having substantially planar pressing surfaces. The smooth roll may comprise a flexible pressing jacket adapted to directly remove the fibrous material web from the band screen, and adapted to supply the material web directly to the second nip, wherein the second nip is formed by a pressing shoe roll and a counter-roll, and the other felt belt is wrapped around the counter roll. The flexible pressing jacket of the shoe pressing roll may transfer the fibrous material web adhering to it to a further process section, after leaving the second nip, directly without an open web run. The second nip may comprise a pressing shoe roll having a rigid smooth jacket such that the pressing shoe roll removes the fibrous material web directly from the band screen without the participation of any belts, and such that the pressing shoe roll supplies the web directly to the second nip, which is formed by the pressing shoe roll and an opposing pressing shoe roll, around which the other felt belt extends. The jacket of the pressing shoe roll may transfer the fibrous material web adhering to it after leaving the second nip to a further process section, directly without an open web run. The device may further comprise a spraying device for moistening at least one of the smooth belt and the smooth roll, wherein the moistening facilitates the removal of the fibrous material web and wherein the moistening is accomplished with one of water and suitable chemicals in order to achieve a reliable adhesion of the fibrous material web. The open roll may be surrounded at least partly by a gutter in order to capture led-away, spun-off water. The pressing device may be for one of a paper and paperboard machine. The open roll may be a suction roll and may include a roll jacket provided with a plurality of radial bores which include radial through-bores, wherein the open roll is subjected to internal suction. The open roll may be a roll tube having a plurality of radial through-holes, and wherein the open roll is subjected to external suction. The recesses may be blind bores. The smooth belt may be guided, after leaving the second nip, so that it transfers the fibrous material web adhering to the smooth belt to a further process section, including a drying cylinder, which is indirectly without an open web run. The further process section may comprise a dryer cylinder. The flexible pressing jacket of the shoe pressing roll may transfer the fibrous material web adhering to it to a further process section, after leaving the second nip, indirectly without an open web run. The further process section may comprise a dryer cylinder. The jacket of the pressing shoe roll may transfer the fibrous material web adhering to it after leaving the second nip to a further process section indirectly without an open web run.

The invention also provides for a method of treating a fibrous material web in a pressing device wherein the method includes forming and carrying the material web upon a band screen, forming a first nip between an open roll and a counter-surface, wherein the first nip is extended in a web running direction, the counter-surface is formed with a pressing shoe unit, and the open roll includes recesses, guiding an open roll felt belt over the open roll, guiding a pressing shoe felt belt over the pressing shoe unit, guiding the material web through the first nip, which presses water out of the material web, suctioning the material web on the band screen using one of the open roll and a suction device, receiving the water pressed out of the material web in the recesses, separating the pressing shoe felt belt from the material web while the material web and the band screen is subjected to suctioning, removing the material web from the band screen via one of a smooth belt and a smooth roll, and guiding the material web and another felt belt through a second nip via one of the smooth belt and the smooth roll.

The method may further comprise evacuating the open roll from the inside without a through-bored cover. The method may further comprise capturing led-away, spun-off water by a gutter surrounding the open roll. The method may further comprise evacuating the open roll from the outside, without a cover having through holes. The open roll felt belt may be guided symmetrically to the plane of pressing of the first nip about the open roll and about the end section of the suction box.

The invention still further provides for a method of treating a fibrous material web in a pressing device wherein the method comprises forming and carrying the material web upon a band screen, forming a first nip between an open roll and a counter-surface, wherein the first nip is extended in a web running direction, the counter-surface is formed with a pressing shoe unit, and the open roll includes recesses, guiding an open roll felt belt over the open roll, guiding a pressing shoe felt belt over the pressing shoe unit, guiding the material web through the first nip, which presses water out of the material web, suctioning the material web on the band screen using one of the open roll and a separating suction device, receiving the water pressed out of the material web in the recesses, separating the pressing shoe felt belt from the material web after the suctioning, separating through the separating suction device the open roll felt belt from the band screen, applying a vacuum suction on the fibrous web in order to dewater the fibrous web together with the band screen, and leading away spun-off water originating from a wedge space defined by the position where the open roll felt belt and the band screen separate such that the separating suction device utilizes a front edge which acts as a deflector strip and extends into the wedge space between the band screen and the open roll felt belt.

The method may further comprise picking up pressed-out water of the fibrous web in order to facilitate even dewatering of the fibrous material web at the first nip by way of a shoe pressing roll which comprises a flexible pressing jacket having an outer surface which has recesses, and providing for even dewatering on both sides of the fibrous web by moving the following through the first nip: a water permeable felt belt; a water permeable band screen; and a water permeable open roll felt belt. The method may further comprise guiding the web over a press roll of the second nip, the second nip being formed by the press roll and a counter-surface. The method may further comprise bringing one of the smooth belt and the smooth roll into contact with the band screen for separating the fibrous material web and simultaneously forming the second nip with a counter-surface. The method may further comprise guiding the smooth belt after leaving the second nip so that it transfers the fibrous material web adhering to the smooth belt to a further process section, such as a drying cylinder which is directly without an open web run. The second nip may comprise a pressing shoe arrangement extending in the web running direction. The pressing may further comprise spraying for moistening at least one of the smooth belt and the smooth roll, wherein the moistening facilitates the separation of the fibrous material web and wherein the moistening is accomplished with one of water or suitable chemicals in order to achieve a reliable adhesion of the fibrous material web.

The invention also provides for a method of treating a fibrous material web in a pressing device wherein the method includes forming and carrying the material web upon a band screen, forming a first nip between an open roll and a counter-surface, wherein the first nip is extended in a web running direction, the counter-surface is formed with a pressing shoe unit, and the open roll includes recesses, guiding an open roll felt belt over the open roll, guiding a pressing shoe felt belt over the pressing shoe unit, evacuating the open roll, guiding the material web through the first nip, which presses water out of the material web, suctioning the material web on the band screen, separating the pressing shoe felt belt from the material web while the material web and the band screen is subjected to suctioning, receiving the water pressed out of the material web in a gutter which surrounds the open roll, separating the open roll felt belt from the band screen after the first nip, removing the material web from the band screen via one of a smooth belt and a smooth roll, and guiding the material web and another felt belt through a second nip via one of the smooth belt and the smooth roll.

The invention also provides for a pressing device for treating a fibrous material web comprising a band screen for carrying the fibrous material web, a roll, a suction device associated with the roll, a gutter surrounding the roll for capturing led-away, spun-off water, an extended first nip which is formed between the roll and a pressing shoe unit, a roll felt belt which is guided over the roll, a pressing shoe felt belt which is guided over the pressing shoe unit, the pressing shoe felt belt being separated from the fibrous material web while the material web and the band screen is subjected to suctioning, a second nip through which a smooth belt and the material web pass after the fibrous material web separates from the band screen via the smooth belt, the second nip being arranged downstream the extended first nip, another felt belt and the smooth belt arranged to travel through the second nip with the material web disposed therebetween, a spraying device for moistening the fibrous material web, and a drying cylinder for drying the fibrous material web, wherein the fibrous material web is removed from the band screen between the extended first nip and the second nip by the smooth belt.

The invention additionally provides for a pressing device for treating a fibrous material web comprising a band screen for carrying the material web which is formed upon it, an open roll comprising recesses for receiving water pressed out of the material web, a first nip extended in a web running direction being formed between the open roll and a counter-surface comprising a pressing shoe unit, the open roll being arranged obliquely beneath the pressing shoe unit, at least one of the open roll and a suction device being provided to suction the material web on the band screen, an open roll felt belt being guided over the open roll and a pressing shoe felt belt being guided over the pressing shoe unit, a second nip arranged downstream the first nip, and another felt belt arranged to travel through the second nip with the material web, wherein the pressing shoe felt belt is separated from the material web while the material web and the band screen is suctioned, and wherein the material web is removed from the band screen between the first and second nips by one of a smooth belt and a smooth roll.

The open roll may be a suction roll and includes a roll jacket provided with a plurality of radial bores which are not through-bores. The device may further comprise a gutter adapted to capture led-away spun-off water, wherein the open roll is at least partly surrounded by the gutter. The device may further comprise an outer suction box which surrounds a portion of the open roll but which is not in contact with the open roll felt belt that is guided over the open roll. The suction box may comprise an end section having a suction opening adjacent the open roll, and wherein the end section is arranged to be substantially parallel to a pressing plane, wherein the open roll projects at least partly through the suction opening into the end section, and wherein at least substantially an entire part of the open roll located outside of the suction box is surrounded by the open roll felt belt, and wherein the open roll felt belt is supported by an outer surface of the end section which is located adjacent to but not in contact with the open roll. The band screen and the fibrous web may be guided away from the open roll at an angle of at least 2° relative to the open roll felt belt. The device may further comprise a separating suction device provided adjacent the band screen and positioned on the side of the open roll where the open roll felt belt separates from the band screen, wherein the separating suction device applies a vacuum suction to the fibrous web in order to dewater the fibrous web together with the screen band, and wherein the separating suction device leads away spun-off water originating from a wedge space defined by the position where the open roll felt belt and band screen separate, such that the separating suction device utilizes a front edge which acts as a deflector strip and extends into the wedge space between the band screen and the open roll felt belt. The separating suction device may further comprise a gutter located transversely to the web running direction for receiving and leading away the spun-off water which is picked up ahead of the deflector strip of the suction separating device.

The invention also provides a method of treating a fibrous material web in a pressing device wherein the method includes forming and carrying the material web upon a band screen, forming a first nip between an open roll and a counter-surface, wherein the first nip is extended in a web running direction, the counter-surface is formed with a pressing shoe unit, and the open roll includes recesses, and wherein the open roll is arranged obliquely beneath the pressing shoe unit, guiding an open roll felt belt over the open roll, guiding a pressing shoe felt belt over the pressing shoe unit, guiding the material web through the first nip, which presses water out of the material web, suctioning the material web on the band screen using one of the open roll and a suction device, receiving the water pressed out of the material web in the recesses, separating the pressing shoe felt belt from the material web while the material web and the band screen is subjected to suctioning, removing the material web from the band screen via one of a smooth belt and a smooth roll, and guiding the material web and another felt belt through a second nip via one of the smooth belt and the smooth roll.

The method may further comprise evacuating the open roll from the inside. The method may further comprise capturing led-away, spun-off water by a gutter surrounding the open roll. The method may further comprise evacuating the open roll from the outside, without a cover having through holes. The open roll felt belt may be guided symmetrically to the plane of pressing of the first nip about the open roll and about the end section of the suction box.

The invention also provides for a method of treating a fibrous material web in a pressing device wherein the method comprises forming and carrying the material web upon a band screen, forming a first nip between an open roll and a counter-surface, wherein the first nip is extended in a web running direction, the counter-surface is formed with a pressing shoe unit, and the open roll includes recesses, and wherein the open roll is arranged obliquely beneath the pressing shoe unit, guiding an open roll felt belt over the open roll, guiding a pressing shoe felt belt over the pressing shoe unit, guiding the material web through the first nip, which presses water out of the material web, suctioning the material web on the band screen using one of the open roll and a suction device, receiving the water pressed out of the material web in the recesses, separating the pressing shoe felt belt from the material web after the suctioning, separating via a suction device the open roll felt belt from the band screen, applying a vacuum suction on the fibrous web in order to dewater the fibrous web together with the band screen, and leading away spun-off water originating from a wedge space defined by the position where the open roll felt belt and the band screen separate such that the suction device utilizes a front edge which acts as a deflector strip and extends into the wedge space between the band screen and the open roll felt belt.

The method may further comprise picking up pressed-out water of the fibrous web in order to facilitate even dewatering of the fibrous material web at the first nip by way of a shoe pressing roll which comprises a flexible pressing jacket having an outer surface which has recesses, and providing for even dewatering on both sides of the fibrous web.

The invention still further provides a pressing device for treating a fibrous material web comprising a band screen for carrying the material web which is formed upon it, a roll comprising recesses for receiving water pressed out of the material web, a first nip extended in a web running direction being formed between the roll and a counter-surface comprising a pressing shoe unit, the roll being arranged obliquely beneath the pressing shoe unit, a suction device for suctioning the material web on the band screen, a roll felt belt being guided over the roll and a pressing shoe felt belt being guided over the pressing shoe unit, a second nip arranged downstream the first nip, and another felt belt arranged to travel through the second nip with the material web, wherein the pressing shoe felt belt is separated from the material web while the material web and the band screen is suctioned, and wherein the material web is removed from the band screen between the first and second nips by one of a smooth belt and a smooth roll.

The device may further comprise a gutter adapted to capture led-away spun-off water, the roll being at least partly surrounded by the gutter.

The invention also provides a pressing device for treating a fibrous material web comprising a band screen for carrying the material web which is formed upon it, a roll comprising recesses for receiving water pressed out of the material web, a first nip extended in a web running direction being formed between the roll and a counter-surface comprising a pressing shoe unit, the roll being arranged obliquely beneath the pressing shoe unit, a suction device for suctioning the material web on the band screen, a roll felt belt being guided over the roll and a pressing shoe felt belt being guided over the pressing shoe unit, the pressing shoe felt belt and the material web being separated from each other after the material web is suctioned, and the suction device provided adjacent the band screen and positioned on the side of the roll where the roll felt belt separates from the band screen, wherein the suction device applies a vacuum suction to the fibrous web in order to dewater the fibrous web together with the band screen, and wherein the suction device leads away spun-off water originating from a wedge space defined by the position where the roll felt belt and the band screen separate, such that the suction device utilizes a front edge which acts as a deflector strip and extends into the wedge space between the band screen and the roll felt belt.

The separating suction device may further comprise a gutter located transversely to the web running direction for receiving and leading away the spun-off water which is picked up ahead of the deflector strip of the suction separating device.

The invention also provides a method of treating a fibrous material web in a pressing device wherein the method includes forming and carrying the material web upon a band screen, forming a first nip between a roll and a counter-surface, wherein the first nip is extended in a web running direction, the counter-surface is formed with a pressing shoe unit, and the roll includes recesses, and wherein the roll is arranged obliquely beneath the pressing shoe unit, guiding a roll felt belt over the roll, guiding a pressing shoe felt belt over the pressing shoe unit, guiding the material web through the first nip, which presses water out of the material web, suctioning the material web on the band screen using a suction device, receiving the water pressed out of the material web in the recesses, separating the pressing shoe felt belt from the material web while the material web and the band screen is subjected to suctioning, removing the material web from the band screen via one of a smooth belt and a smooth roll, and guiding the material web and another felt belt through a second nip via one of the smooth belt and the smooth roll.

The method may further comprise capturing led-away, spun-off water by a gutter surrounding the roll. The method may further comprise evacuating the roll from the outside, without a cover having through holes. The method may further comprise separating using the suction device the roll felt belt from the band screen, applying a vacuum suction on the fibrous web in order to dewater the fibrous web together with the band screen, and leading away spun-off water originating from a wedge space defined by the position where the roll felt belt and band screen separate such that the separating suction device utilizes a front edge which acts as a deflector strip and extends into the wedge space between the band screen and the roll felt belt. The method may further comprise picking up pressed-out water of the fibrous web in order to facilitate even dewatering of the fibrous material web at the first nip by way of a shoe pressing roll which comprises a flexible pressing jacket having an outer surface which has recesses, and providing for even dewatering on both sides of the fibrous web.

The invention also provides a pressing device for treating a fibrous material web comprising a band screen for carrying the material web which is formed upon it, a first nip extended in a web running direction being formed between a roll and a counter-surface comprising a pressing shoe unit, the roll being arranged obliquely beneath the pressing shoe unit, a suction device being provided to suction the material web on the band screen, a roll felt belt being guided over the roll and a pressing shoe felt belt being guided over the pressing shoe unit, a spraying device, a press roll arranged to remove the material web from the band screen, a second nip arranged downstream the first nip, and another felt belt arranged to travel through the second nip with the material web, wherein the pressing shoe felt belt is separated from the material web while the material web and the band screen is suctioned, and wherein the material web is removed from the band screen between the first and second nips by one of a smooth belt and a smooth roll.

The invention also provides for a method of treating a fibrous material web in a pressing device wherein the method includes forming and carrying the material web upon a band screen, forming a first nip between a roll and a counter-surface, wherein the first nip is extended in a web running direction, the counter-surface is formed with a pressing shoe unit, and the roll is arranged obliquely beneath the pressing shoe unit, guiding a roll felt belt over the roll, guiding a pressing shoe felt belt over the pressing shoe unit, guiding the material web through the first nip, which presses water out of the material web, suctioning the material web on the band screen, separating the pressing shoe felt belt from the material web while the material web and the band screen is subjected to suctioning, receiving the water pressed out of the material web in a gutter arranged adjacent the roll, separating the roll felt belt from the band screen after the first nip, spraying the material web using a spraying device, removing the material web from the band screen via one of a smooth belt and a smooth roll, and guiding the material web and another felt belt through a second nip via one of the smooth belt and the smooth roll.

In the invention the counter-surface associated with the open roll is formed by a pressing shoe unit for the formation of a first nip extended in the web running direction and a respective felt belt is guided over both the open roll and also over the pressing shoe unit.

Thus, a double felt shoe press is provided in the region of the band screen guided around the open roll, which ensures a careful mechanical dewatering in both directions. In addition, a relatively flat pressure gradient results in the first nip. This signifies a dewatering in the first nip which protects the volume and a good dewatering in the second press as a result of the lower pre-compression in comparison to normal roll presses. The main dewatering in the region of this first nip takes place in the direction of the band screen and of the open roll. None of the customary suction rolls are no longer necessary in the pressing section. A significantly lower vacuum requirement results in comparison to the customary pressing devices.

In an embodiment of the pressing device of the invention the pressing shoe unit associated with the open roll is formed by a pressing shoe roll.

The open roll may have a grooved and/or blind bored surface with an impermeable press roll jacket lying beneath it.

The open roll can, for example, also be a conventional suction roll and a roll jacket provided with many radial bores and may be subjected to suction from the inside, without or with a through-bored cover.

The open roll can be at least partly surrounded by a gutter in order to catch and lead away the spun off water.

The open roll is, however, expediently formed by a roll tube having many through formed radial bores and may also be subjected to suction from the outside, without or with a through-drilled cover.

In this arrangement an external suction box is associated with the open roll and is sealed off towards the outside at its suction side adjacent the open roll by the felt belt guided over the open roll. In this arrangement it is preferable that the suction box includes an end section with a suction opening formed substantially parallel to the pressing plane and adjacent the open roll. A slipping seal would no longer be provided between the suction box and the open roll, which would prevent changes of the remaining gaps from occuring due to roll deflections The open roll may project partly through the suction opening into the end section and at least substantially the whole part of the open roll lying outside of the suction box is surrounded by the associated felt belt. Thus, the felt belt is supported by the outer surface of the end section of the suction box adjacent to, but not contacting the open roll, with the two gaps between the roll and the suction box simultaneously being covered over by the felt belt.

The dewatering advantageously takes place downwardly.

In another embodiment the felt belt is guided symmetrically to the pressing plane of the first nip around the open roll and the end section of the suction box. The open roll subjected to suction from the outside can thus be made more stable. Moreover, less power is required for the maintenance of the vacuum than with a conventional suction roll which is subjected to suction from the inside.

It is advantages if the band screen together with the fibrous material web leaves the open roll by an angle of at least 2° earlier than the felt belt.

A separating suction device may be provided within the band screen after separation of the open roll and the felt belt and may satisfy the following functions:

vacuum sucking on of the fibrous web, dewatering of the fibrous web together with the band screen, leading away of spun off water originating from the wedge space or from the open roll by utilizes a front edge which acts as a deflector strip and extends into the wedge space between the screen belt and the felt belt.

A gutter may also be provided transversely over the machine width in order to pick up and lead away the spun off water picked up before the deflector strip of the separating suction device.

In another embodiment, the flexible press jacket of the pressing shoe roll has an outer surface which has suitable recesses, preferably blind bores, in order to take up pressed out water of the fibrous material web, whereby dewatering of the fibrous material web which is as even as possible takes place in the first nip to both sides of the fibrous material web, so that the nip is formed from the top to the bottom by:

the jacket surface which takes up water the water permeable felt belt which takes up water, the fibrous material web, the water permeable screen belt, the water permeable felt belt which takes up water and the surface which takes up water.

The pressing shoe roll may be at least partly surrounded by a suitable gutter in order to pick up and lead away the spun off water from the recesses of the flexible pressing jacket.

In most cases it is advantages if the fibrous material web led together with the belt screen around the open roll and through the first nip is subsequently guided through at least one further nip after the removal from the band screen has taken place.

In accordance with another embodiment of the pressing device of the invention the removal of the fibrous material web from the band screen takes place after the first press by a belt, with the latter being guided with the fibrous material web adhering to it through the further nip and being provided, at least at the side confronting the fibrous material web, with a smooth closed surface.

It is also of particular advantage if no form be of pick up roll is any longer required.

The smooth belt may be separated from the band screen with the fibrous material web adhering to it, and may be guided over a press roll which, together with a counter-surface, forms a felted further nip.

The smooth belt may also be brought into contact with the band screen by the press roll for the removal of the fibrous material web, with the press roll simultaneously forming the further nip with a counter-surface.

After leaving the nip the smooth belt is preferably guided on further so that it transfers the fibrous material web adhering to the belt to a further process section, preferably to a dryer cylinder, directly or indirectly without an open web run.

In another embodiment the removal of the fibrous material web from the band screen takes place after the first press by a felt belt, with the latter being guided with the fibrous material web adhering to it through the further nip.

The removal of the fibrous material web from the band screen can also be assisted by the suction action of a suction roll, such as in particular of a pick up roll, while the latter brings the felt belt into contact with the band screen.

The further nip may be formed by a pressing shoe arrangement and extended in the web running direction. In this case the counter-surface may be formed by a pressing shoe unit, or by a pressing shoe roll, with a felt belt being guided through this nip.

The further nip may advantageously be formed by a press roll which is a pressing shoe roll, whereby an inversion of the rolls results.

The pressing shoe unit may generally be arranged beneath the oppositely disposed press roll which takes over the smooth belt separated from the band screen.

In accordance with another embodiment, the press roll and/or the counter-roll has a roll jacket which is supported opposite to the associated counter-surface by at least one support element.

In another embodiment both rolls may be are pressing shoe rolls, each having a flexible pressing jacket, and the pressing shoes of which may have a substantially planar pressing surface.

A respective felt belt may also be guided through the nip on both sides of the fibrous material web.

It may be of particular advantage when the flexible pressing jacket of the pressing shoe roll takes over the fibrous material web directly from the band screen, i.e. without the participation of a felt belt or smooth belt, and leads it directly to the pressing gap which is formed by the pressing shoe roll and the counter-roll, around which the felt belt extends.

After leaving the nip, the pressing jacket of the pressing shoe roll may pass on the fibrous material web adhering to it to a further process section, preferably to a dryer cylinder, directly or indirectly without an open web run.

In another embodiment, provision is made such that the press roll is provided with a smooth, rigid jacket which takes off the fibrous material web directly from the band screen, i.e. without the participation of a felt belt or smooth belt, and leads it directly to the nip which is formed by this roll and the pressing shoe roll around which the felt belt extends.

After leaving the nip the jacket of the press roll may pass on the fibrous material web adhering to it to a further process section, such as a dryer cylinder, directly or indirectly without an open web run.

Thus, many configurations are possible, amongst other things, in which the removal of the fibrous material web by the belt screen takes place either by a smooth impermeable belt, by a felt belt or by a smooth roll surface, with it being possible to bring the fibrous material web into contact with the respective pick up element, for example by pivoting of a screen guide roll.

A spraying device may also be provided which moistens the belt or the flexible pressing jacket of the pressing shoe roll or the rigid smooth jacket of the press roll at the outer side temporarily at the first removal of the fibrous material web, or permanently, with water or suitable chemicals in order to achieve a reliable adhesion of the fibrous material web.

In the pressing arrangement of the invention achieving closed web guidance from the screen to the drying section is thus possible. In total, ideal runnability can result. Such a tension-free or low-tension web guidance can bring further technological advantages with it. As a result of maintaining the reduction of the reverse moistening to a minimum, a relatively high dry content can result. An ideal pressing device in every aspect can thus be realized with two extended nips, with a dewatering which is as protective of the volume as possible being ensured. A pressing roll may also be associated with the first dryer cylinder of the dryer section, whereby an ideal smoothness can be achieved on both sides. In this way the requirement of an additional belt guided around the guide roll can, for example, be omitted.

Moreover, the number of press rolls may be reduced to a minimum. As a result, this leads to low reserves, low servicing costs and also to low manufacturing costs, which in total enables a low sales price.

Moreover, an extremely compact construction is possible. Thus, the spacing between the open suction roll of the first nip and the first dryer cylinder of the dryer section can, for example, amount to 4 m, which is some 6.5 m shorter than a conventional pressing device. As a result of the smaller constructional space, the accommodation in smaller buildings is possible, which further reduces the respective investment costs.

According to another embodiment of the invention there is provided a method of treating a fibrous material web in a pressing device which includes forming and carrying the material web upon a band screen, forming a first nip between an open roll and a counter surface, wherein the first nip is extended in a web direction, the counter-surface is formed with a pressing shoe unit, and the open roll includes recesses, guiding an open roll felt belt over the open roll, guiding a pressing shoe felt belt over the pressing shoe unit, guiding the material web through the first nip, which presses out water out of the material web and receiving the water pressed out of the material web in the recesses.

The method includes evacuating the open roll from the inside without a through-bored cover, capturing led-away, spun-off water by a gutter surrounding the open roll, and evacuating the open roll from the outside, without a cover having through holes.

The method provides for the open roll felt belt to be guided symmetrically to the plane of pressing of the first nip about the open roll and about the end section of the suction box.

The invention includes separating, through a suction device, the felt belt from the screen belt, applying a vacuum suction on the fibrous web in order to dewater the fibrous web together with the screen band, and leading away spun-off water originating from a wedge space defined by the position where the felt belt and screen belt separate. In this manner the separating suction device utilizes a front edge which acts as a deflector strip and extends into the wedge space between the screen belt and the felt belt.

The method further includes picking up pressed-out water of the fibrous web in order to facilitate even dewatering of the fibrous material web at the first nip by way of a shoe pressing roll which comprises a flexible pressing jacket having an outer surface which has recesses, and providing for even dewatering on both sides of the fibrous web by moving the following through the first nip: the water permeable felt belt; a water permeable band screen; and a water permeable open roll felt belt.

The method includes leading the fibrous material web together with the band screen around the open roll and through a first pressing gap and being subsequently guided, after it has been separated from the band screen, to at least one second pressing gap.

The method further comprises separating the fibrous material web from the band screen after the first nip by a second belt, the second belt being guided, with the fibrous material web adhering to it, to a second nip; and providing the second belt, at least at its side adjacent the fibrous material web with a smooth, closed surface.

According to the invention, the pressing further comprises separating the web from the band screen and being guided, with the fibrous material web adhering to it, over a press roll, thereby forming a second felted nip with a counter-surface. The smooth belt is brought by the press roll into contact with the band screen for separating the fibrous material web and simultaneously forming the second felted nip with a counter-surface.

The method further provides for guiding the smooth belt after leaving the second felted nip so that it transfers the fibrous material web adhering to the smooth belt to a further process section, such as a drying cylinder which is directly without an open web run.

Additionally, the method provides for separating the fibrous material web from the band screen after the first nip by a second felt belt, and the second felt belt being guided with the fibrous material web adhering to it through a second nip. The method provides for pressing which further includes forming a second nip by a pressing shoe arrangement and extending in the web running direction.

Additionally, provision is made for guiding at least two additional felt belts through a second nip on both sides of the fibrous material web.

According to an aspect of the invention, pressing further includes spraying for moistening at least one of the second belt, or the flexible press jacket of the opposing pressing shoe roll, or the rigid smooth jacket of the pressing shoe roll. The moistening facilitates the separation of the fibrous material web and is accomplished with one of water or suitable chemicals in order to achieve a reliable adhesion of the fibrous material web.

According to another aspect of the invention, there is provided a method of treating a fibrous material web in a pressing device which includes, forming and carrying the material web upon a band screen; forming a first nip between an open roll and a counter-surface, wherein the first nip is extended in a web running direction, the counter-surface is formed with a pressing shoe unit, and the open roll includes recesses; guiding an open roll felt belt over the open roll; guiding a pressing shoe felt belt over the pressing shoe unit; evacuating the open roll; guiding the material web through the first nip, which presses water out of the material web; receiving the water pressed out of the material web in a gutter which surrounds the open roll; separating the felt belt from the screen belt; guiding the fibrous material web through a second nip whereby even dewatering on both sides of the fibrous material web occurs.

According to yet another aspect of the invention, a pressing device is provided for treating a fibrous material web having a band screen for carrying the fibrous material web, an open roll in the form of a pressing shoe unit comprising recesses for receiving water, a suction device associated with the open roll, a gutter surrounding the open roll for capturing led-away, spun-off water, and an extended first nip which is formed between the open roll and a counter-surface. The device also includes an open roll felt belt which is guided over the open roll, a pressing shoe felt belt which is guided over the pressing shoe unit, a second felted nip formed by a smooth belt which separates the fibrous material web from the band screen, a spraying device for moistening the fibrous material web, and a drying cylinder for drying the fibrous material web.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

The invention will be explained in more detail in the following with reference to embodiments and to the drawings, in which are shown.

DETAILED DESCRIPTION OF THE PRESENT INVENTION

Figure 1:
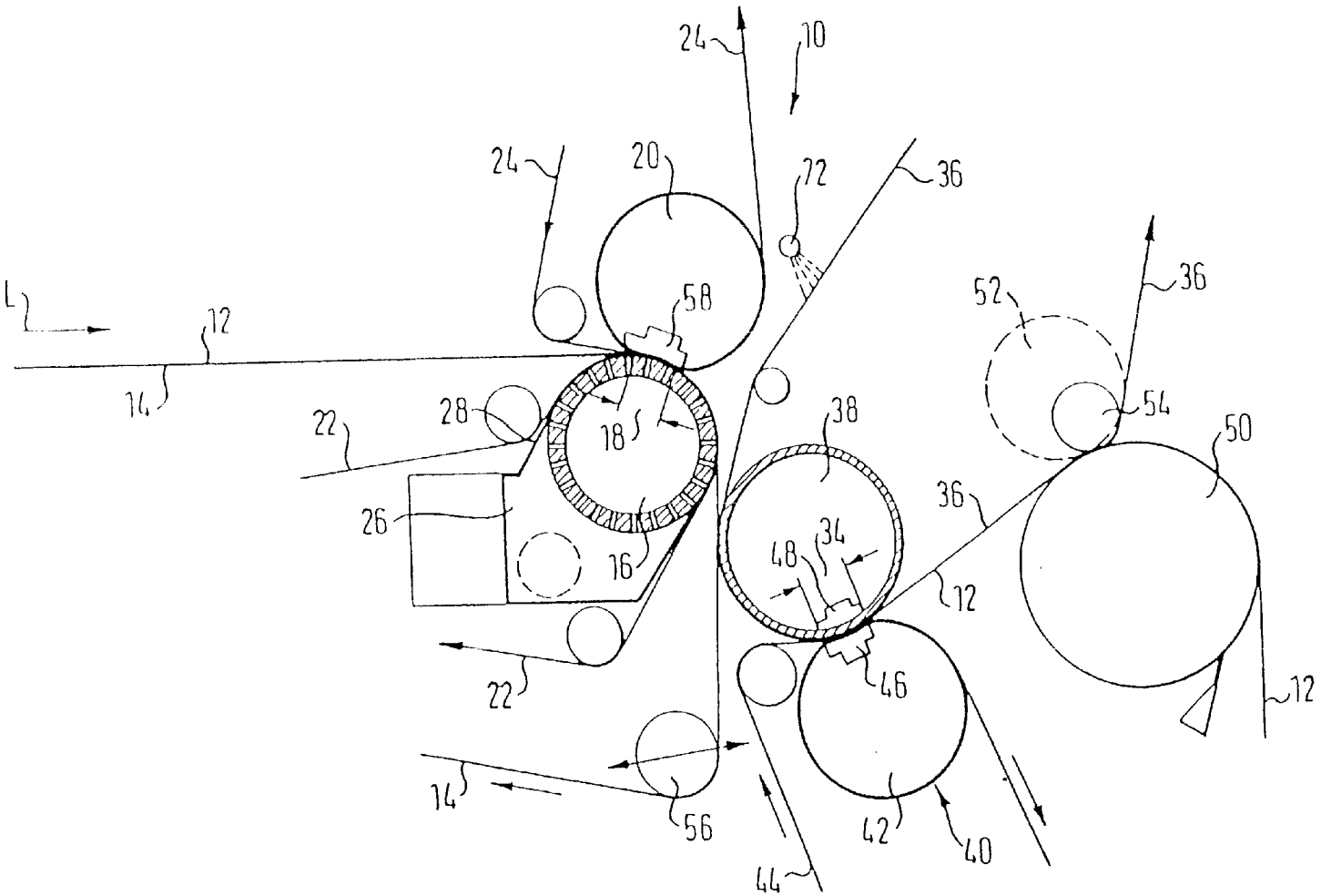
FIG. 1 shows a schematic side view of an embodiment of a pressing device in which the open roll is subjected to suction from the outside.

FIG. 1 shows, in a purely schematic representation, a pressing device 10 of a paper and/or paper board machine for the treatment of a fibrous material web 12. In this arrangement the fibrous material web 12 formed on a band screen 14 is guided together with the band screen 14 around an open roll 16, which is suitable to take up water pressed out of the fibrous material web and which forms a first nip with a counter-surface. The open roll is here subjected to suction from the outside, purely by way of example.

The counter-surface associated with the open roll 16 is formed by a pressing shoe unit 20 for the formation of an extended nip 18 in the web running direction L. A respective felt belt 22, 24 is directly guided over both the screen suction roll 16 and also over the pressing shoe unit 20 (see also FIG. 2).

In this case the pressing shoe unit 20 associated with the open roll 16 is formed by a pressing shoe roll.

Figure 2:
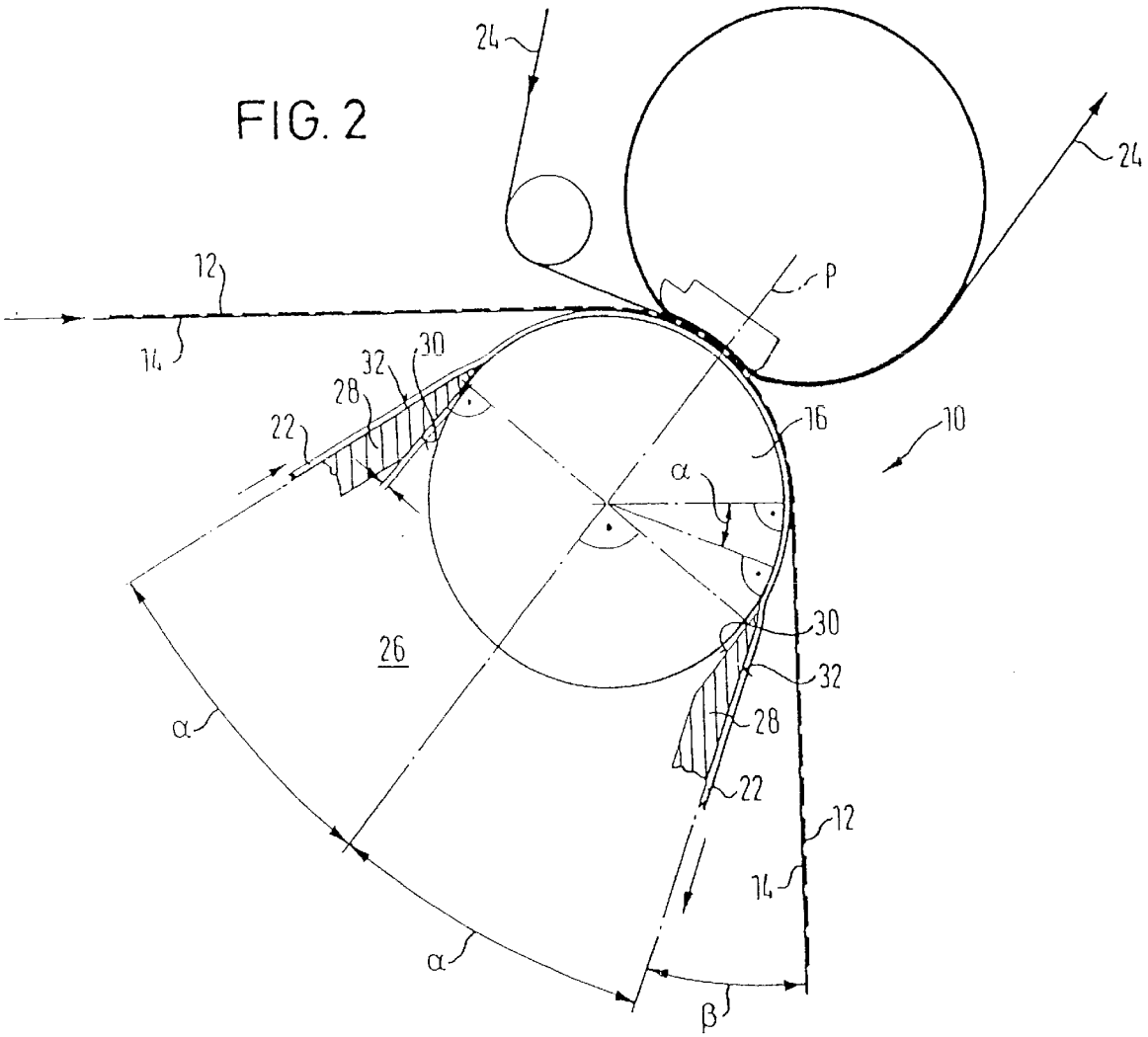
FIG. 2 shows an enlarged representation of the end section, adjacent to the open roll, of an embodiment of the suction box of the pressing device shown in FIG. 1.

An outer suction box 26 is associated with this open roll 16 in the manner illustrated in FIGS. 1 and 2. This suction box 26 is covered over towards the outside at its suction side confronting the open roll 16 in the manner which will be described in more detail further below by the felt belt 22, which is guided over the screen suction roll 16.

As can best be seen with reference to the embodiment of FIG. 2, the suction box 26 includes an end section 28 with a suction opening 30 formed substantially parallel to the press roll and adjacent the screen suction roll 16. The screen suction roll 16 projects in the manner illustrated in FIG. 2 partly through the suction opening 30 into the end section 28.

At least substantially the whole part of the screen suction roll 16 lying outside of the suction box 26 is surrounded by the associated felt belt 22. Following this the felt belt 22 is supported by the outer surface 32 of the end section 28 of the suction box 26 adjacent to but not contacting the screen suction roll 16, with the two gaps between the roll and the suction box being simultaneously covered over by the felt belt.

The felt belt 22 is guided in the manner illustrated in FIG. 2 by the screen suction roll 16 and the end section 28 of the suction box 26 symmetrically to the pressing plane P of the first nip 18 (see also FIG. 1), since in each case a respective angle $\alpha$ is defined on the two sides of the pressing plane P.

The band screen 14 leaves the open roll together with the fibrous material web 12 by an angle $\beta$ of at least 2° earlier than the felt belt 22.

The fibrous material web 12 guided together with the band screen 14 around the screen suction roll 16 and through the first nip 18 is subsequently guided, after removal from the band screen 14, through a further nip 34 (see FIG. 1).

During this the removal of the fibrous material web 12 from the band screen 14 takes place by a belt 36, which is guided with the fibrous material web 12 adhering to it through the further nip 34 and is provided, at least at its side facing the fibrous material web 12 with a smooth, i.e. substantially closed, surface.

As can be seen in FIG. 1, the smooth belt 36 with the fibrous material web 12 adhering to it is guided over a press roll 38, which, together with a counter-surface, forms the felted further nip 34.

In this arrangement the further nip 34 is formed in the illustrated manner by a pressing shoe arrangement 40 and extended in the web running direction L.

In this case the counter-surface which forms the further nip 34 with the press roll 38 is formed by a pressing shoe unit 42, which, can be a pressing shoe roll, around which a felt belt 44 is guided.

The press roll 38 can have a rigid roll jacket which is supported relative to the pressing shoe 46 of the pressing shoe unit 42 by at least one support element 48 and can also be provided with a smooth surface.

Following the further nip 34, the smooth belt 36 with the fibrous material web 12 adhering to it is guided around the first dryer cylinder 50 of the dryer section.

In order to achieve smoothness on both sides, which is as ideal as possible, a pressing roll 52 can be associated with the dryer cylinder 50, with a further pressing position for the fibrous material web 12 to be treated being formed by the pressing roll 52 with the dryer cylinder 50 and with the fibrous material web being led together with the smooth belt 36 through this pressing position. A pressing roll 52 of this kind can be provided in the illustrated manner as an alternative to a guide roll 54 intended for this belt 36 and arranged in the region of the dryer cylinder 50.

As can be seen with reference to FIG. 1, the open roll 16 can be, arranged obliquely beneath the pressing shoe unit 20 with the associated pressing shoe 58. The band screen 14, the fibrous material web 12 and the smooth belt 36 are led substantially vertically downwardly between the screen suction roll 16 and the pressing roll 38. The pressing shoe unit 42 is arranged obliquely beneath the pressing roll 38, while the optionally provided pressing roll 52 lies obliquely above the dryer cylinder 50.

Figure 3:
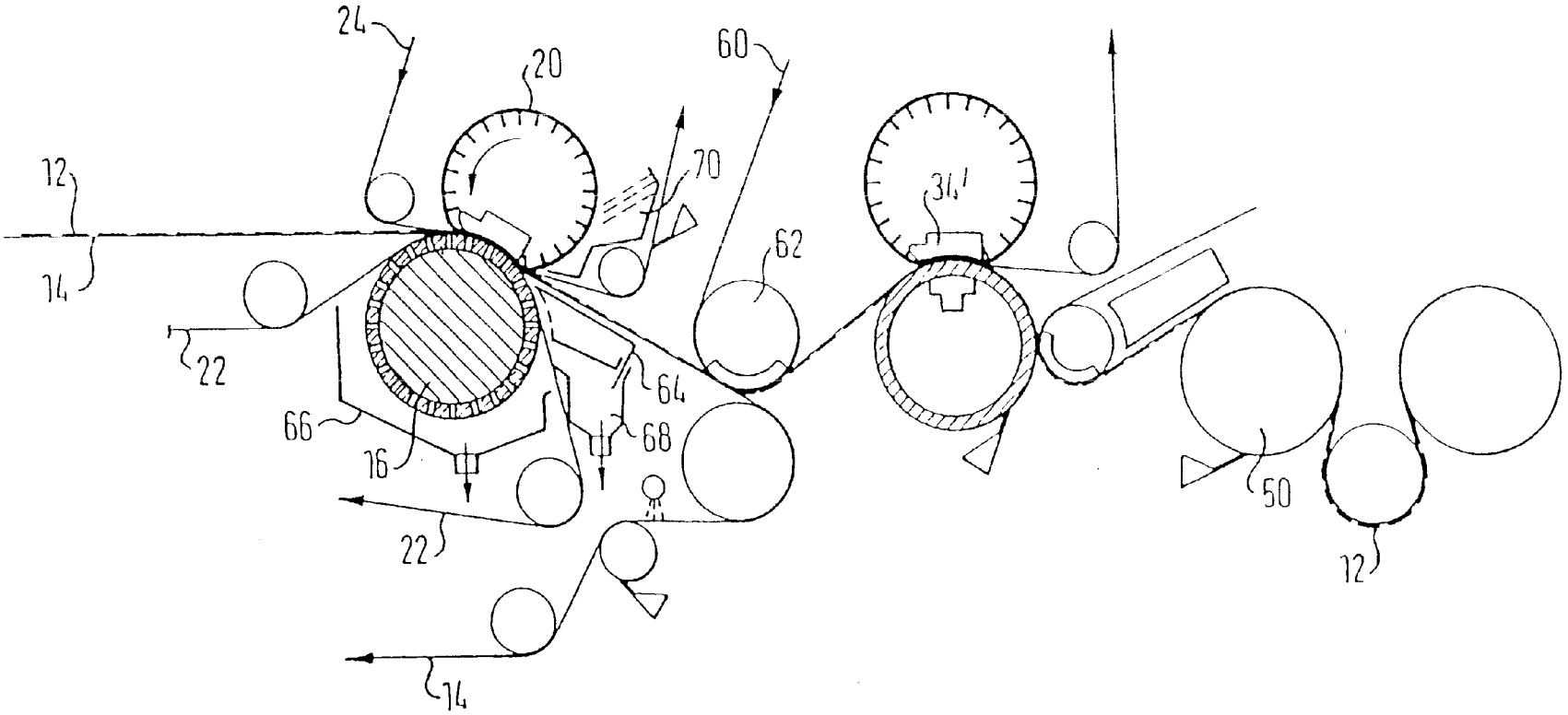
FIG. 3 shows another embodiment of a pressing device with an open roll having a grooved or blind bored surface and a suction roll to assist in the removal of the fibrous material web from the band screen.

FIG. 3 shows another embodiment of a pressing device having an open roll 16 with a grooved and/or blind bored surface and a pick up roll 62, around which the felt belt 60 extends, to assist the removal of the fibrous material web from the band screen 14.

The open roll 16 is surrounded at least partly by a gutter 66 in order to catch and lead away the spun off water.

A separating suction device 64 is provided within the band screen 14 at the latter, after separation from the open roll 16 and the felt belt 22 and satisfies the following functions:

vacuum sucking on of the fibrous web 12, dewatering of the fibrous web 12 together with the screen band 14, leading away of spun off water originating from the wedge space or from the open roll 16 by its front edge which acts as a deflector strip and extends into the wedge space between the screen belt 14 and the felt belt 22.

A gutter 68 is provided transversely over the machine width in order to pick up and lead away the spun off water picked up before the deflector strip of the separating suction device 64.

The flexible pressing jacket of the pressing shoe roll 20 has an outer surface which has suitable recesses, such as in particular blind bores and/or grooves in order to pick up pressed out water of the fibrous material web, whereby an even dewatering of the fibrous material web 12 results, which is as uniform as possible in the first nip to both sides of the fibrous material web 12, so that the nip is formed from the top to the bottom of the following:

a jacket surface which takes up water a water permeable felt belt 24 which takes up water, the fibrous material web 12, the water permeable band screen 14, the water permeable felt belt 22 which takes up water and the roll surface 16 which takes up water.

The pressing shoe roll 20 is at least partly surrounded by a suitable gutter 70 in order to pick up and lead away the spun off water from the recesses of the flexible pressing jacket.

The fibrous material web 12, which is guided together with the band screen 14 about the open roll 16 and through the first nip is subsequently guided, after removal from the band screen 14, through a further nip 34'.

The removal of the fibrous material web 12 from the band screen 14 after the first press takes place through the felt belt 60, which is guided, together with the fibrous material web 12 adhering to it, through the further nip 34'. In this arrangement the removal is assisted by the sucking action of the suction roll 62, while the latter brings the felt belt 60 into contact with the band screen 14. The roll 62 thus serves as a pick up roll.

A further nip 34' is again formed by a pressing shoe arrangement. In this arrangement the upwardly disposed pressing shoe roll can have, in just the same way as in the case of the first pressing shoe, a blind bored and/or grooved pressing jacket. Following this nip 34' extended in the web running direction, the fibrous material web 12 is fed to a dryer cylinder 50.

The roll 16 can in particular be provided with a blind bored and/or grooved covering. This roll can, for example, be a pressing roll or a hydro-statically inwardly supported roll.

Figure 4:
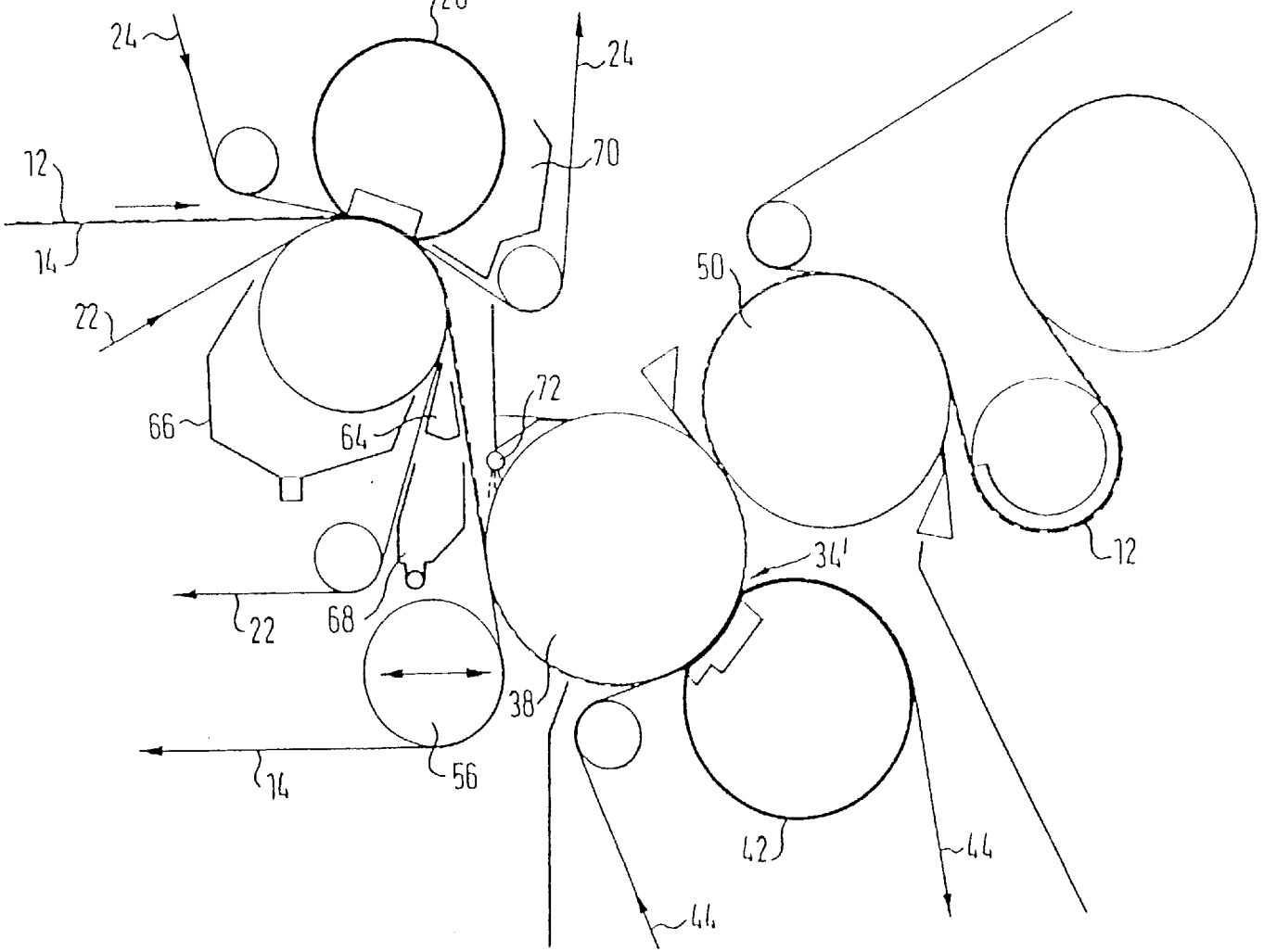
FIG. 4 shows another embodiment of a pressing device in which the fibrous material web is directly removed from the band screen by a press roll.

FIG. 4 shows a further embodiment of a pressing device, in which the fibrous material web 12 is taken off by a press roll 38 directly from the band screen 14.

The counter-surface to the press roll 38 is formed by a pressing shoe unit 42, in the illustrated embodiment a shoe pressing roll. A felt belt 44 is guided through the nip 34' lying therebetween.

In the illustrated embodiment, the press roll 38 has a rigid roll jacket. A pressing shoe roll with a flexible roll jacket can, however, also be provided.

The press roll 38 provided in the present case with a rigid smooth jacket takes up the fibrous material web 12 directly from the band screen 14, i.e. without the participation of a felt belt or smooth belt, in order to supply it directly to the nip 34', which is formed by the same press roll 38 and the pressing shoe roll 42 around which the felt belt 44 extends.

The jacket of the press roll 38 passes on the fibrous material web 12 adhering to it after leaving the nip 34 directly, without an open web run, to a dryer cylinder 50.

Moreover, a spraying apparatus 72 is provided which moistens the smooth jacket of the press roll 38 with water or suitable chemicals on the outside temporarily for the first removal of the fibrous material web, or permanently, in order to achieve a reliable adhesion of the fibrous material web 12.

In other respects the embodiment shown in FIG. 4 has a comparable layout to that of FIG. 3, with the same reference numerals being associated with parts which correspond to one another.

The fibrous material web can be brought into contact with the respective pick up element (see for example FIGS. 1 and 4) by pivoting of a screen guide roll 56.

What is claimed is:

1. A pressing device for treating a fibrous material web comprising:

a band screen for carrying the material web which is formed upon it;

an open roll comprising recesses for receiving water pressed out of the material web;

a first nip extended in a web running direction being formed between the open roll and a counter-surface comprising a pressing shoe unit;

at least one of the open roll and a suction device being provided to suction the material web on the band screen;

an open roll felt belt being guided over the open roll and a pressing shoe felt belt being guided over the pressing shoe unit;

a second nip arranged downstream the first nip; and another felt belt arranged to travel through the second nip with the material web, wherein the pressing shoe felt belt is separated from the material web while the material web and the band screen is suctioned, and wherein the material web is removed from the band screen between the first and second nips by one of a smooth belt and a smooth roll.

2. The device of claim 1, wherein the pressing shoe unit associated with the open roll is a shoe pressing roll.

3. The device of claim 1, wherein the open roll comprises a surface having at least one of grooves and blind bores, said open roll further comprising a non-permeable press roll jacket lying beneath the surface.

4. The device of claim 1, wherein the open roll is a suction roll and includes a roll jacket provided with a plurality of radial bores which are not through-bores;

wherein the open roll is internally suctioned.

5. The device of claim 3, further comprising a gutter adapted to capture led-away spun-off water, wherein the open roll is at least partly surrounded by the gutter.

6. The device of claim 1, wherein the open roll is a roll tube having a plurality of radial bores which are not through-bores, and wherein the open roll is externally suctioned.

7. The device of claim 6, further comprising an outer suction box which surrounds a portion of the open roll but which is not in contact with the open roll felt belt that is guided over the open roll.

8. The device of claim 7, wherein the suction box comprises an end section having a suction opening adjacent the open roll, and wherein the end section is arranged to be substantially parallel to a pressing plane;

wherein the open roll projects at least partly through the suction opening into the end section;

wherein at least substantially an entire part of the open roll located outside of the suction box is surrounded by the open roll felt belt, and wherein the open roll felt belt is supported by an outer surface of the end section which is located adjacent to but not in contact with the open roll.

9. The device of claim 8, wherein the open roll felt belt is guided symmetrically to a pressing plane of the first nip about the open roll and about the end section of the suction box.

10. The device of claim 1, wherein the band screen and the fibrous web are guided away from the open roll at an angle of at least 2° relative to the open roll felt belt.

11. The device of claim 2, wherein the shoe pressing roll comprises a flexible pressing jacket having an outer surface having recesses for receiving pressed-out water from the fibrous web, thereby facilitating even dewatering of the fibrous material web at the first nip, and wherein even dewatering results on both sides of the fibrous web when the first nip comprises: the jacket surface; a water permeable felt belt; a water permeable band screen; a water permeable open roll felt belt; and the roll surface.

12. The device of claim 11, wherein the shoe pressing roll is at least partly surrounded by a gutter for capturing and leading away the spun-off water from the recesses of the flexible pressing jacket.

13. The device of claim 1, wherein the second nip is formed by a press roll and a counter-surface.

14. The device of claim 13, wherein the material web is guided, after leaving the second nip, on the smooth belt to a further process section which is directly without an open web run, wherein the further process section includes a drying cylinder.

15. The device of claim 1, wherein the second nip is formed by a pressing shoe arrangement which is extended in the web running direction.

16. The device of claim 15, wherein the pressing shoe arrangement comprises a shoe press roll and a counter-surface.

17. The device of claim 13, wherein at least one of the press roll and the counter-surface, comprises a roll jacket which is supported by at least one support element against the other of the at least one of the press roll and the counter-surface.

18. The device of claim 13, wherein the press roll and the counter-surface both comprise pressing shoe rolls with flexible pressing jackets having substantially planar pressing surfaces.

19. The device of claim 1, wherein the smooth roll comprises a flexible pressing jacket adapted to directly remove the fibrous material web from the band screen, and adapted to supply the material web directly to the second nip, wherein the second nip is formed by a pressing shoe roll and a counter-roll, and the other felt belt is wrapped around the counter roll.

20. The device of claim 19, wherein the flexible pressing jacket of the shoe pressing roll transfers the fibrous material web adhering to it to a further process section, after leaving the second nip, directly without an open web run.

21. The device of claim 1, wherein the second nip comprises a pressing shoe roll having a rigid smooth jacket such that the pressing shoe roll removes the fibrous material web directly from the band screen without the participation of any belts, and such that the pressing shoe roll supplies the web directly to the second nip, which is formed by the pressing shoe roll and an opposing pressing shoe roll, around which the other felt belt extends.

22. The device of claim 21, wherein the jacket of the pressing shoe roll transfers the fibrous material web adhering to it after leaving the second nip to a further process section, directly without an open web run.

23. The device of claim 1, further comprising a spraying device for moistening at least one of the smooth belt and the smooth roll;

wherein the moistening facilitates the removal of the fibrous material web and wherein the moistening is accomplished with one of water and suitable chemicals in order to achieve a reliable adhesion of the fibrous material web.

24. The device of claim 4, wherein the open roll is surrounded at least partly by a gutter in order to capture led-away, spun-off water.

25. The pressing device of claim 1, wherein the pressing device is for one of a paper and paperboard machine.

26. The device of claim 1, wherein the open roll is a suction roll and includes a roll jacket provided with a plurality of radial bores which include radial through-bores;

wherein the open roll is subjected to internal suction.

27. The device of claim 1, wherein the open roll is a roll tube having a plurality of radial through-holes, and wherein the open roll is subjected to external suction.

28. The device of claim 1, wherein the smooth belt is guided, after leaving the second nip, so that it transfers the fibrous material web adhering to the smooth belt to a further process section, including a drying cylinder, which is indirectly without an open web run.

29. The device of claim 20, wherein the further process section comprises a dryer cylinder.

30. The device of claim 19, wherein the flexible pressing jacket of the shoe pressing roll transfers the fibrous material web adhering to it to a further process section, after leaving the second nip, indirectly without an open web run.

31. The device of claim 22, wherein the further process section comprises a dryer cylinder.

32. The device of claim 21, wherein the jacket of the pressing shoe roll transfers the fibrous material web adhering to it after leaving the second nip to a further process section indirectly without an open web run.

33. A pressing device for treating a fibrous material web comprising:

a band screen for carrying the material web which is formed upon it;

an open roll comprising recesses for receiving water pressed out of the material web;

a first nip extended in a web running direction being formed between the open roll and a counter-surface comprising a pressing shoe unit;

at least one of the open roll and a suction device being provided to suction the material web on the band screen;

an open roll felt belt being guided over the open roll and a pressing shoe felt belt being guided over the pressing shoe unit;

the pressing shoe felt belt and the material web being separated from each other after the material web is suctioned;

the band screen and the fibrous web being guided away from the open roll at an angle of at least 2° relative to the open roll felt belt; and a separating suction device provided adjacent the band screen and positioned on the side of the open roll where the open roll felt belt separates from the band screen, wherein the separating suction device applies a vacuum suction to the fibrous web in order to dewater the fibrous web together with the band screen; and wherein the separating suction device leads away spun-off water originating from a wedge space defined by the position where the open roll felt belt and band screen separate, such that the separating suction device utilizes a front edge which acts as a deflector strip and extends into the wedge space between the band screen and the open roll felt belt.

34. The device of claim 33, wherein the separating suction device further comprises a gutter located transversely to the web running direction for receiving and leading away the spun-off water which is picked up ahead of the deflector strip of the suction separating device.

35. The device of claim 11, wherein the recesses are blind bores.

36. A method of treating a fibrous material web in a pressing device comprising:

forming and carrying the material web upon a band screen;

forming a first nip between an open roll and a counter-surface, wherein the first nip is extended in a web running direction, the counter-surface is formed with a pressing shoe unit, and the open roll includes recesses;

guiding an open roll felt belt over the open roll;

guiding a pressing shoe felt belt over the pressing shoe unit;

guiding the material web through the first nip, which presses water out of the material web;

suctioning the material web on the band screen using one of the open roll and a suction device;

receiving the water pressed out of the material web in the recesses;

separating the pressing shoe felt belt from the material web while the material web and the band screen is subjected to suctioning;

removing the material web from the band screen via one of a smooth belt and a smooth roll; and guiding the material web and another felt belt through a second nip via one of the smooth belt and the smooth roll.

37. The method of claim 36, further comprising:

evacuating the open roll from the inside without a through-bored cover.

38. The method of claim 36, further comprising:

capturing led-away, spun-off water by a gutter surrounding the open roll.

39. The method of claim 36, further comprising:

evacuating the open roll from the outside, without a cover having through holes.

40. The method of claim 36, wherein the open roll felt belt is guided symmetrically to the plane of pressing of the first nip about the open roll and about the end section of the suction box.

41. The method of claim 36, further comprising:

picking up pressed-out water of the fibrous web in order to facilitate even dewatering of the fibrous material web at the first nip by way of a shoe pressing roll which comprises a flexible pressing jacket having an outer surface which has recesses; and providing for even dewatering on both sides of the fibrous web by moving the following through the first nip: a water permeable felt belt; a water permeable band screen; and a water permeable open roll felt belt.

42. The method of claim 36, further comprising guiding the web over a press roll of the second nip, the second nip being formed by the press roll and a counter-surface.

43. The method of claim 42, further comprising bringing one of the smooth belt and the smooth roll into contact with the band screen for separating the fibrous material web and simultaneously forming the second nip with a counter-surface.

44. The method of claim 43, further comprising guiding the smooth belt after leaving the second nip so that it transfers the fibrous material web adhering to the smooth belt to a further process section, such as a drying cylinder which is directly without an open web run.

45. The method of claim 36, wherein the second nip comprises a pressing shoe arrangement extending in the web running direction.

46. The method of claim 36, wherein the pressing further comprises spraying for moistening at least one of the smooth belt and the smooth roll;

wherein the moistening facilitates the separation of the fibrous material web and wherein the moistening is accomplished with one of water or suitable chemicals in order to achieve a reliable adhesion of the fibrous material web.

47. A method of treating a fibrous material web in a pressing device comprising:

forming and carrying the material web upon a band screen;

forming a first nip between an open roll and a counter-surface, wherein the first nip is extended in a web running direction, the counter-surface is formed with a pressing shoe unit, and the open roll includes recesses;

guiding an open roll felt belt over the open roll;

guiding a pressing shoe felt belt over the pressing shoe unit;

guiding the material web through the first nip, which presses water out of the material web;

suctioning the material web on the band screen using one of the open roll and a separating suction device;

receiving the water pressed out of the material web in the recesses;

separating the pressing shoe felt belt from the material web after the suctioning;

separating through the separating suction device the open roll felt belt from the band screen;

applying a vacuum suction on the fibrous web in order to dewater the fibrous web together with the band screen; and leading away spun-off water originating from a wedge space defined by the position where the open roll felt belt and the band screen separate such that the separating suction device utilizes a front edge which acts as a deflector strip and extends into the wedge space between the band screen and the open roll felt belt.

48. A method of treating a fibrous material web in a pressing device comprising:

forming and carrying the material web upon a band screen;

forming a first nip between an open roll and a counter-surface, wherein the first nip is extended in a web running direction, the counter-surface is formed with a pressing shoe unit, and the open roll includes recesses;

guiding an open roll felt belt over the open roll;

guiding a pressing shoe felt belt over the pressing shoe unit;

evacuating the open roll;

guiding the material web through the first nip, which presses water out of the material web;

suctioning the material web on the band screen;

separating the pressing shoe felt belt from the material web while the material web and the band screen is subjected to suctioning;

receiving the water pressed out of the material web in a gutter which surrounds the open roll;

separating the open roll felt belt from the band screen after the first nip;

removing the material web from the band screen via one of a smooth belt and a smooth roll; and guiding the material web and another felt belt through a second nip via one of the smooth belt and the smooth roll.

49. A pressing device for treating a fibrous material web comprising:

a band screen for carrying the fibrous material web;

a roll;

a suction device associated with the roll;

a gutter surrounding the roll for capturing led-away, spun-off water;

an extended first nip which is formed between the roll and a pressing shoe unit;

a roll felt belt which is guided over the roll;

a pressing shoe felt belt which is guided over the pressing shoe unit;

the pressing shoe felt belt being separated from the fibrous material web while the material web and the band screen is subjected to suctioning;

a second nip through which a smooth belt and the material web pass after the fibrous material web separates from the band screen via the smooth belt;

the second nip being arranged downstream the extended first nip;

another felt belt and the smooth belt arranged to travel through the second nip with the material web disposed therebetween;

a spraying device for moistening the fibrous material web; and a drying cylinder for drying the fibrous material web, wherein the fibrous material web is removed from the band screen between the extended first nip and the second nip by the smooth belt.

50. A pressing device for treating a fibrous material web comprising:

a band screen for carrying the material web which is formed upon it;

an open roll comprising recesses for receiving water pressed out of the material web;

a first nip extended in a web running direction being formed between the open roll and a counter-surface comprising a pressing shoe unit;

the open roll being arranged obliquely beneath the pressing shoe unit;

at least one of the open roll and a suction device being provided to suction the material web on the band screen;

an open roll felt belt being guided over the open roll and a pressing shoe felt belt being guided over the pressing shoe unit;

a second nip arranged downstream the first nip; and another felt belt arranged to travel through the second nip with the material web, wherein the pressing shoe felt belt is separated from the material web while the material web and the band screen is suctioned, and wherein the material web is removed from the band screen between the first and second nips by one of a smooth belt and a smooth roll.

51. The device of claim 50, wherein the open roll is a suction roll and includes a roll jacket provided with a plurality of radial bores which are not through-bores.

52. The device of claim 50, further comprising a gutter adapted to capture led-away spun-off water, wherein the open roll is at least partly surrounded by the gutter.

53. The device of claim 50, further comprising an outer suction box which surrounds a portion of the open roll but which is not in contact with the open roll felt belt that is guided over the open roll.

54. The device of claim 53, wherein the suction box comprises an end section having a suction opening adjacent the open roll, and wherein the end section is arranged to be substantially parallel to a pressing plane;

wherein the open roll projects at least partly through the suction opening into the end section;

wherein at least substantially an entire part of the open roll located outside of the suction box is surrounded by the open roll felt belt, and wherein the open roll felt belt is supported by an outer surface of the end section which is located adjacent to but not in contact with the open roll.

55. The device of claim 50, wherein the band screen and the fibrous web are guided away from the open roll at an angle of at least 2° relative to the open roll felt belt.

56. The device of claim 55, further comprising a separating suction device provided adjacent the band screen and positioned on the side of the open roll where the open roll felt belt separates from the band screen;

wherein the separating suction device applies a vacuum suction to the fibrous web in order to dewater the fibrous web together with the screen band; and wherein the separating suction device leads away spun-off water originating from a wedge space defined by the position where the open roll felt belt and band screen separate, such that the separating suction device utilizes a front edge which acts as a deflector strip and extends into the wedge space between the band screen and the open roll felt belt.

57. The device of claim 56, wherein the separating suction device further comprises a gutter located transversely to the web running direction for receiving and leading away the spun-off water which is picked up ahead of the deflector strip of the suction separating device.

58. A method of treating a fibrous material web in a pressing device comprising:

forming and carrying the material web upon a band screen;

forming a first nip between an open roll and a counter-surface, wherein the first nip is extended in a web running direction, the counter-surface is formed with a pressing shoe unit, and the open roll includes recesses, and wherein the open roll is arranged obliquely beneath the pressing shoe unit;

guiding an open roll felt belt over the open roll;

guiding a pressing shoe felt belt over the pressing shoe unit;

guiding the material web through the first nip, which presses water out of the material web;

suctioning the material web on the band screen using one of the open roll and a suction device;

receiving the water pressed out of the material web in the recesses;

separating the pressing shoe felt belt from the material web while the material web and the band screen is subjected to suctioning;

removing the material web from the band screen via one of a smooth belt and a smooth roll; and guiding the material web and another felt belt through a second nip via one of the smooth belt and the smooth roll.

59. The method of claim 58, further comprising: evacuating the open roll from the inside.

60. The method of claim 58, further comprising:

capturing led-away, spun-off water by a gutter surrounding the open roll.

61. The method of claim 58, further comprising:

evacuating the open roll from the outside, without a cover having through holes.

62. The method of claim 58, wherein the open roll felt belt is guided symmetrically to the plane of pressing of the first nip about the open roll and about the end section of the suction box.

63. The method of claim 58, further comprising:

picking up pressed-out water of the fibrous web in order to facilitate even dewatering of the fibrous material web at the first nip by way of a shoe pressing roll which comprises a flexible pressing jacket having an outer surface which has recesses; and providing for even dewatering on both sides of the fibrous web.

64. A method of treating a fibrous material web in a pressing device comprising:

forming and carrying the material web upon a band screen;

forming a first nip between an open roll and a counter-surface, wherein the first nip is extended in a web running direction, the counter-surface is formed with a pressing shoe unit, and the open roll includes recesses, and wherein the open roll is arranged obliquely beneath the pressing shoe unit;

guiding an open roll felt belt over the open roll;

guiding a pressing shoe felt belt over the pressing shoe unit;

guiding the material web through the first nip, which presses water out of the material web;

suctioning the material web on the band screen using one of the open roll and a suction device;

receiving the water pressed out of the material web in the recesses;

separating the pressing shoe felt belt from the material web after the suctioning;

separating via a suction device the open roll felt belt from the band screen;

applying a vacuum suction on the fibrous web in order to dewater the fibrous web together with the band screen; and leading away spun-off water originating from a wedge space defined by the position where the open roll felt belt and the band screen separate such that the suction device utilizes a front edge which acts as a deflector strip and extends into the wedge space between the band screen and the open roll felt belt.

65. A pressing device for treating a fibrous material web comprising:

a band screen for carrying the material web which is formed upon it;

a roll comprising recesses for receiving water pressed out of the material web;

a first nip extended in a web running direction being formed between the roll and a counter-surface comprising a pressing shoe unit;

the roll being arranged obliquely beneath the pressing shoe unit;

a suction device for suctioning the material web on the band screen;

a roll felt belt being guided over the roll and a pressing shoe felt belt being guided over the pressing shoe unit;

a second nip arranged downstream the first nip; and another felt belt arranged to travel through the second nip with the material web, wherein the pressing shoe felt belt is separated from the material web while the material web and the band screen is suctioned, and wherein the material web is removed from the band screen between the first and second nips by one of a smooth belt and a smooth roll.

66. The device of claim 65, further comprising a gutter adapted to capture led-away spun-off water, the roll being at least partly surrounded by the gutter.

67. A pressing device for treating a fibrous material web comprising:

a band screen for carrying the material web which is formed upon it;

a roll comprising recesses for receiving water pressed out of the material web;

a first nip extended in a web running direction being formed between the roll and a counter-surface comprising a pressing shoe unit;

the roll being arranged obliquely beneath the pressing shoe unit;

a suction device for suctioning the material web on the band screen;

a roll felt belt being guided over the roll and a pressing shoe felt belt being guided over the pressing shoe unit;

the pressing shoe felt belt and the material web being separated from each other after the material web is suctioned; and the suction device being provided adjacent the band screen and being positioned on the side of the roll where the roll felt belt separates from the band screen, wherein the suction device applies a vacuum suction to the fibrous web in order to dewater the fibrous web together with the band screen, and wherein the suction device leads away spun-off water originating from a wedge space defined by the position where the roll felt belt and the band screen separate, such that the suction device utilizes a front edge which acts as a deflector strip and extends into the wedge space between the band screen and the roll felt belt.

68. The device of claim 67, wherein the separating suction device further comprises a gutter located transversely to the web running direction for receiving and leading away the spun-off water which is picked up ahead of the deflector strip of the suction separating device.

69. A method of treating a fibrous material web in a pressing device comprising:

forming and carrying the material web upon a band screen;

forming a first nip between a roll and a counter-surface, wherein the first nip is extended in a web running direction, the counter-surface is formed with a pressing shoe unit, and the roll includes recesses, and wherein the roll is arranged obliquely beneath the pressing shoe unit;

guiding a roll felt belt over the roll;

guiding a pressing shoe felt belt over the pressing shoe unit;

guiding the material web through the first nip, which presses water out of the material web;

suctioning the material web on the band screen using a suction device;

receiving the water pressed out of the material web in the recesses;

separating the pressing shoe felt belt from the material web while the material web and the band screen is subjected to suctioning;

removing the material web from the band screen via one of a smooth belt and a smooth roll; and guiding the material web and another felt belt through a second nip via one of the smooth belt and the smooth roll.

70. The method of claim 69, further comprising:

capturing led-away, spun-off water by a gutter surrounding the roll.

71. The method of claim 69, further comprising:

evacuating the roll from the outside, without a cover having through holes.

72. The method of claim 69, further comprising:

separating using the suction device the roll felt belt from the band screen;

applying a vacuum suction on the fibrous web in order to dewater the fibrous web together with the band screen; and leading away spun-off water originating from a wedge space defined by the position where the roll felt belt and band screen separate such that the separating suction device utilizes a front edge which acts as a deflector strip and extends into the wedge space between the band screen and the roll felt belt.

73. The method of claim 69, further comprising:

picking up pressed-out water of the fibrous web in order to facilitate even dewatering of the fibrous material web at the first nip by way of a shoe pressing roll which comprises a flexible pressing jacket having an outer surface which has recesses; and providing for even dewatering on both sides of the fibrous web.

74. A pressing device for treating a fibrous material web comprising:

a band screen for carrying the material web which is formed upon it;

a first nip extended in a web running direction being formed between a roll and a counter-surface comprising a pressing shoe unit;

the roll being arranged obliquely beneath the pressing shoe unit;

a suction device being provided to suction the material web on the band screen;

a roll felt belt being guided over the roll and a pressing shoe felt belt being guided over the pressing shoe unit;

a spraying device;

a press roll arranged to remove the material web from the band screen;

a second nip arranged downstream the first nip; and another felt belt arranged to travel through the second nip with the material web, wherein the pressing shoe felt belt is separated from the material web while the material web and the band screen is suctioned, and wherein the material web is removed from the band screen between the first and second nips by one of a smooth belt and a smooth roll.

75. A method of treating a fibrous material web in a pressing device comprising:

forming and carrying the material web upon a band screen;

forming a first nip between a roll and a counter-surface, wherein the first nip is extended in a web running direction, the counter-surface is formed with a pressing shoe unit, and the roll is arranged obliquely beneath the pressing shoe unit;

guiding a roll felt belt over the roll;

guiding a pressing shoe felt belt over the pressing shoe unit;

guiding the material web through the first nip, which presses water out of the material web;

suctioning the material web on the band screen;

separating the pressing shoe felt belt from the material web while the material web and the band screen is subjected to suctioning;

receiving the water pressed out of the material web in a gutter arranged adjacent the roll;

separating the roll felt belt from the band screen after the first nip;

spraying the material web using a spraying device;

removing the material web from the band screen via one of a smooth belt and a smooth roll; and guiding the material web and another felt belt through a second nip via one of the smooth belt and the smooth roll.

* * * * *